US006874794B2

(12) United States Patent
Holland

(10) Patent No.: US 6,874,794 B2
(45) **Date of Patent: *Apr. 5, 2005**

(54) SAFETY BRAKE USING BEARINGS FOR IN-LINE SKATES

(75) Inventor: Ronald A Holland, Newport Beach, CA (US)

(73) Assignee: Hemisphere Group, Inc., Irvine, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/192,947

(22) Filed: Jul. 11, 2002

(65) Prior Publication Data

US 2003/0189301 A1 Oct. 9, 2003

(Under 37 CFR 1.47)

Related U.S. Application Data

(63) Continuation-in-part of application No. 09/302,542, filed on Apr. 30, 1999, now Pat. No. 6,425,588.

(51) Int. Cl.[7] ..... A63C 17/14; A63C 17/02; A63C 17/04; A63C 17/22; B60T 1/00

(52) U.S. Cl. ..... 280/11.206; 280/11.204; 280/11.208; 280/11.211; 280/11.216; 280/11.221; 280/11.232; 280/11.28; 301/5.301; 301/6.1; 188/30

(58) Field of Search ..... 280/11.206, 11.204, 280/11.208, 11.211, 11.19, 11.221, 11.222, 11.231, 11.232, 11.233, 208, 11.201, 11.207, 11.217, 87.021, 87.041, 87.042; 188/5, 29, 30, 82.1–82.9; 301/5.301, 6.1

(56) References Cited

U.S. PATENT DOCUMENTS

| | | | | |
|---|---|---|---|---|
| 4,526,389 A | * | 7/1985 | Chase | 280/11.201 |
| 4,817,974 A | | 4/1989 | Bergeron | 280/11.2 |
| 5,135,244 A | | 8/1992 | Allison | 280/11.22 |
| 5,192,099 A | | 3/1993 | Riutta | 280/11.2 |
| 5,207,438 A | | 5/1993 | Landers | 280/11.2 |
| 5,342,071 A | | 8/1994 | Soo | 280/11.2 |
| 5,413,362 A | * | 5/1995 | De Santis | 280/11.206 |
| 5,462,295 A | | 10/1995 | Seltzer | 280/11.19 |
| 5,465,984 A | | 11/1995 | Pellegrini, Jr. et al. | 280/11.2 |
| 5,478,094 A | | 12/1995 | Pennestri | 280/11.2 |
| 5,486,011 A | | 1/1996 | Nelson | 280/11.2 |

(Continued)

*Primary Examiner*—Christopher P. Ellis
*Assistant Examiner*—Gerald B. Klebe
(74) *Attorney, Agent, or Firm*—Law Offices of David L. Hoffman

(57) ABSTRACT

A braking system preferably for an in-line skate includes a brake pad mounted to a forward end of a skate frame and an elevated front wheel attached to the skate frame by two pivot arms. The pivot arms are biased forward which is in a clockwise direction with respect to their pivot point. When skating normally, the pivot arms bias the wheel against the brake pad, but the wheel is elevated from the skating surface and thus the brake is not engaged. When skating in a rearward direction, or desiring a push start, the skater rotates the toe portion of the skate downward and raises the heel. The front wheel will engage the skating surface and the reaction force on the wheel due to friction between it and the skating surface will urge the wheel forward and increase the contact pressure between it and the brake pad. When skating forward, if the skater rotates his or her foot so that the front wheel engages the skating surface, the frictional force between the surface and the wheel causes a rearward force on the wheel away from the brake pad, thus ensuring that the skater will not trip due to sudden braking of the front wheel. An alternate embodiment uses a bearing or bearings as the brake.

8 Claims, 6 Drawing Sheets

U.S. PATENT DOCUMENTS 5,527,048 A 6/1996 Conte ..... 280/112
5,527,049 A 6/1996 Ortiz ..... 280/11.2
5,551,712 A 9/1996 Repucci ..... 280/11.2
5,582,418 A 12/1996 Closser ..... 280/11.22
5,630,595 A 5/1997 Perner ..... 280/11.2
5,630,597 A * 5/1997 Klukos ..... 280/11.217
5,685,550 A 11/1997 Mayer, II ..... 280/11.2
5,709,395 A 1/1998 Lee ..... 280/11.2
5,873,583 A * 2/1999 Moore ..... 280/11.201
5,924,704 A * 7/1999 Johnson ..... 280/11.211
6,170,837 B1 * 1/2001 Ross ..... 280/1
6,322,088 B1 * 11/2001 Klamer et al. ..... 280/11.27

* cited by examiner 1
2
3
3a
8
9
10
4
6

B
12
P
3
16
3a
10
4
6
9

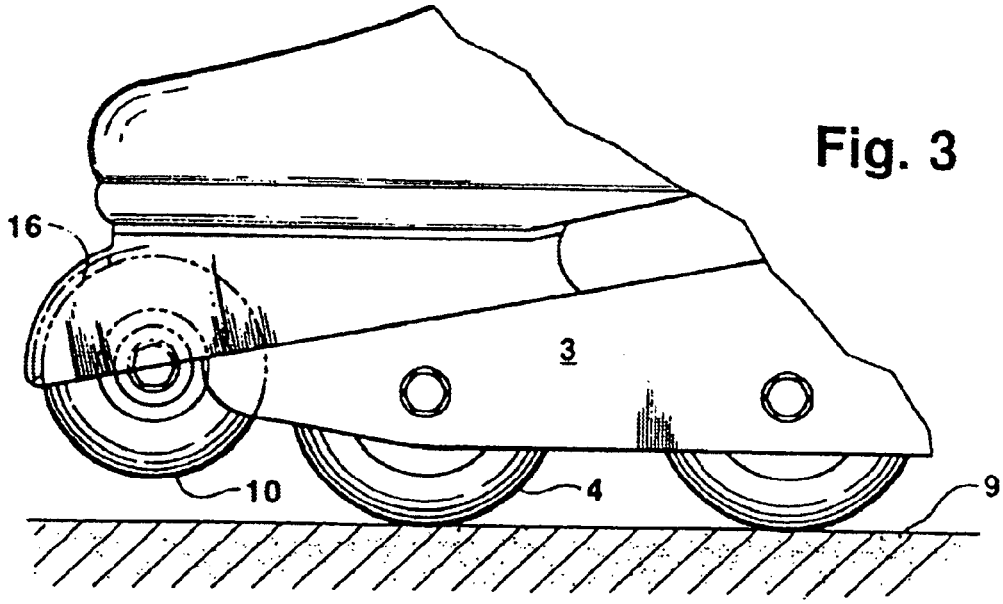
Fig. 3
Fig. 4
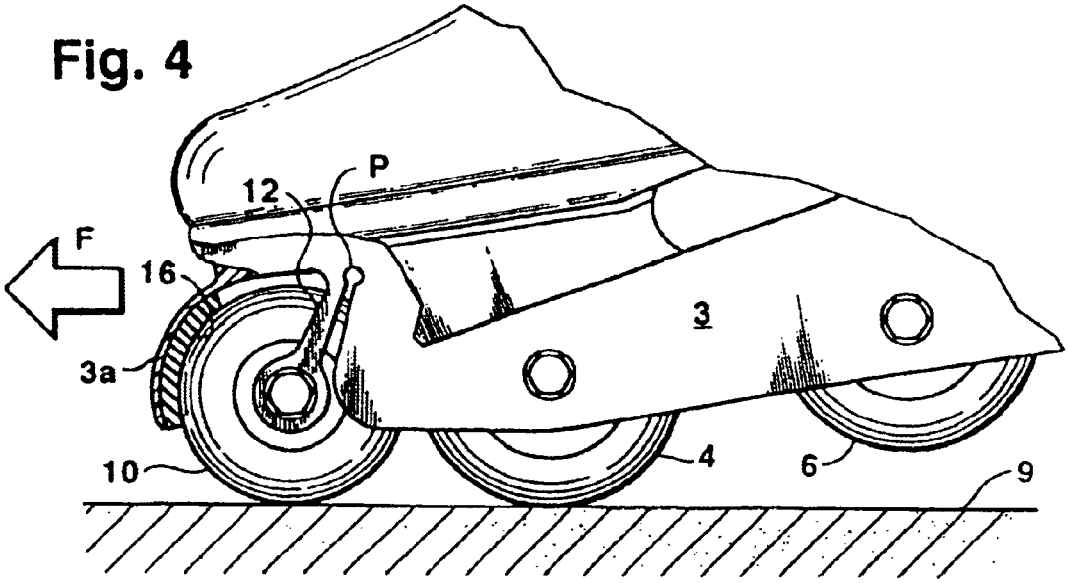

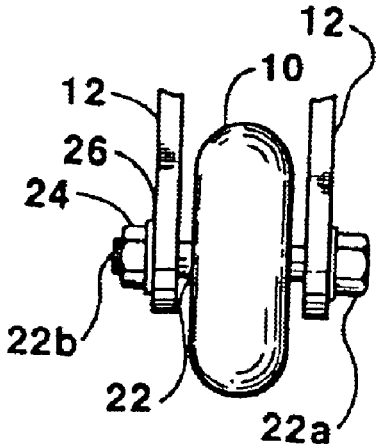
Fig. 5
Fig. 6
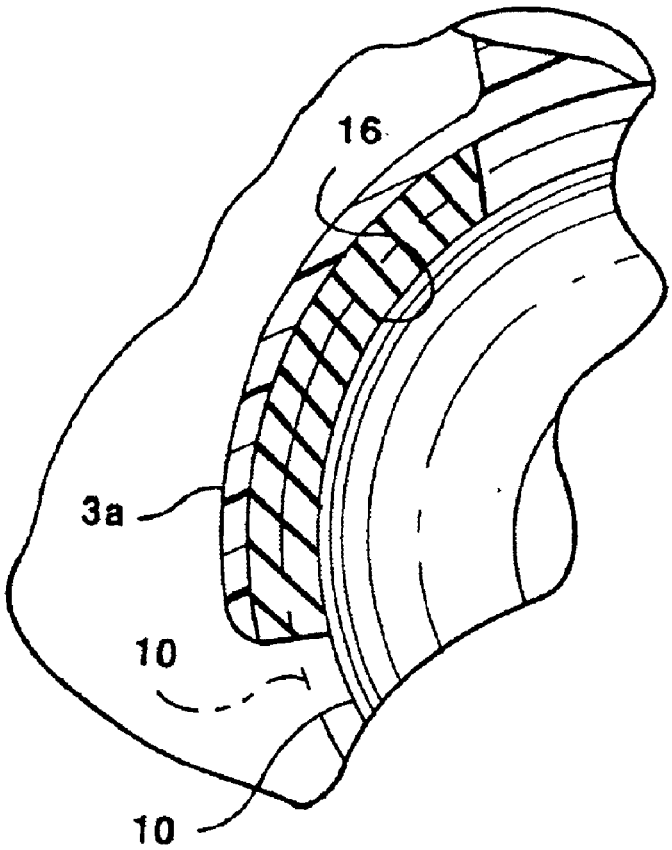

SAFETY BRAKE USING BEARINGS FOR IN-LINE SKATES

CROSS-REFERENCE TO RELATED APPLICATION

This is a continuation-in-part application of U.S. patent application Ser. No. 09/302,542, filed Apr. 30, 1999, now U.S. Pat. No. 6,425,588 B1 published Jul. 30, 2002, which is hereby incorporated by reference.

BACKGROUND OF THE INVENTION

The present invention relates to a brake for in-line skates, and in particular, to a front brake which is difficult to unintentionally actuate yet provides a reliable braking force.

In-line skating has become increasingly popular. In many ways, it is similar to ice skating. Accordingly, playing hockey on in-line skates has also become popular. Standard in-line skates have a brake pad located at the heel of the skate. The brake is actuated by bending the knee of one leg and extending the other leg forward while rotating the toes upward and the heel downward as much as possible so that the brake will contact the ground. This is awkward for trying to stop or to hold one's ground against being pushed, or for obtaining a quick start. It is also awkward and potentially will trip the skater if used to stop while going backwards. While one can perform a T-stop, such a stop will damage the wheels and would be difficult to engage while moving backwards.

It is also useful to turn the skate sideways to get a push start, as in ice skating. However, a push start cannot be initiated with one's skates aligned. It is desirable to obtain a push start without turning the skate so that one can rapidly go from stopped to skating. It is also desirable to be able to stop safely while going backwards, and to be able to resist someone pushing the skater backwards. It is further desirable that such a brake be safe from causing the skater to trip over it when skating forwards. Such a brake would also be helpful in couples skating and for the novice skater.

Several attempts at brakes having some of these characteristics have been made. For example, U.S. Pat. No. 5,192,099 to Riutta discloses a braking system for use on the front or rear wheel of an in-line skate. The brake prevents reverse rotation of the wheel. Specifically, reverse rotation of the front wheel is prevented by a restraining member which is connected to the skate frame in the region above and behind the front wheel. The free end of the restraining member constantly bears against the front wheel and is equipped with teeth or serrations which frictionally engage the front wheel and which bite upon reverse rotation of the wheel. These teeth allow forward rotation of the front wheel. While this brake can provide a push start, the teeth can damage the wheel. In addition, although the teeth may not engage when the wheel is rotating forward, they can cause some drag on the wheel and may cause skidding and wheel damage. Furthermore, it is not possible to provide a variable braking force. Perhaps most importantly, this brake prevents reverse skating. Even if one could skate backwards somehow, when the brake is applied, it is abrupt and could cause skidding, damage to the wheel, and/or trip the skater.

A front wheel brake which is not activated during normal skating is taught by U.S. Pat. No. 5,486,011 to Nelson. The front wheel is spring-biased downward. There is a brake pad above it. There will be a braking force for forward or rearward skating by pressing down on the front wheel with sufficient force, whereupon the front wheel will contact the braking pad. The Nelson brake is activated by downward force only and thus has limited braking force for providing a push start or preventing rearward rotation. More importantly, when skating forward, if one tilted one's foot, the brake could catch and trip the skater.

What is needed is a one-way brake which is not activated during normal skating, which can be applied with a variable force, and which is not cumbersome to use yet provides a secure braking force.

SUMMARY OF THE INVENTION

In one embodiment, the invention provides a safety brake for an in-line type of skate or other roller skate. The front wheel of the skate is elevated with respect to the line formed by the skating surface of the other wheels. It is biased forward by attachment to the skate frame by an elongated arm. A braking pad is located on the frame to the front of the wheel such that the rest position of the wheel is against the brake pad. When skating normally, whether skating forwards or backwards, the front wheel will not contact the ground and thus the brake will not be actuated. If the skater happens to lean forward while skating forward, a frictional reaction force will tend to push the wheel toward the back of the skate, thus deactivating the brake. When the skater wants a push start, or wants to get in a set position such as for contact, the skater leans forward and pushes backward on the skate. The front wheel is pushed forward with respect to the skate and is securely engaged by the brake pad.

In an alternate embodiment, the brake is formed by one or more bearings mounted to the skate frame. The principals governing operation of the invention are similar. In addition, if the user is skating forwards with the front wheel on the skating surface, the front wheel will be turning counterclockwise viewed from the left side. The bearing or bearings will be turning clockwise viewed from the same side. That is, it is preferred to keep light contact between the front wheel and the bearings. The bearings are preferably very low friction so as not to impede skating. They will spin freely in the clockwise direction when viewed from the left.

When the skater needs to push off or hold his or her ground in response to being pushed backwards, if the skater has the front wheel on the skating plane, the front wheel will tend to turn clockwise when viewed from the left. However, the bearings, preferably one way bearings, will not rotate counterclockwise when viewed from the left. Accordingly, the front wheel will not rotate and the bearings function as a brake.

In a further embodiment, the front wheel may be movably mounted so that its axis moves laterally forward and upward when the skater is pushing off or skating backwards with the front wheel on the skating plane or surface. When the skater moves forward, the front wheel will move backwards away from the brake pad or bearings.

With this construction, the skater can push off, and even walk forward or climb a hill using a pushing off type of motion. Such a motion, i.e., one which tends to rotate the front wheel clockwise when viewed from the left, will cause the brake to engage and give the skater traction. This would allow a skater, for example, to climb a quarter pipe with very little weight pressure on the front wheel.

BRIEF DESCRIPTION OF THE DRAWINGS

FIG. 3 is an enlarged side view similar to FIG. 1 with the front wheel elevated and showing in phantom the front wheel biased against the brake pad in its neutral position where the skater is skating forward with no pressure on the front wheel;

FIG. 4 is a view similar to that of FIG. 2 but showing the brake partially disengaged;

FIG. 5 is an enlarged front view of the front wheel and its mounting to the frame;

FIG. 6 is an enlarged sectional and partial view of the wheel and brake pad engagement of FIG. 2 in phantom and FIG. 4 in solid;

DESCRIPTION OF THE PREFERRED EMBODIMENT(S)

The detailed description set forth below in connection with the appended drawings is intended as a description of a presently preferred embodiment of the invention and is not intended to represent the only forms in which the present invention may be constructed and/or utilized. The description sets forth the functions and the sequence of steps for constructing and operating the invention in connection with the illustrated embodiments. However, it is to be understood that the same or equivalent functions and sequence may be accomplished by different embodiments that are also intended to be encompassed within the spirit and scope of the invention.

Figure 1:
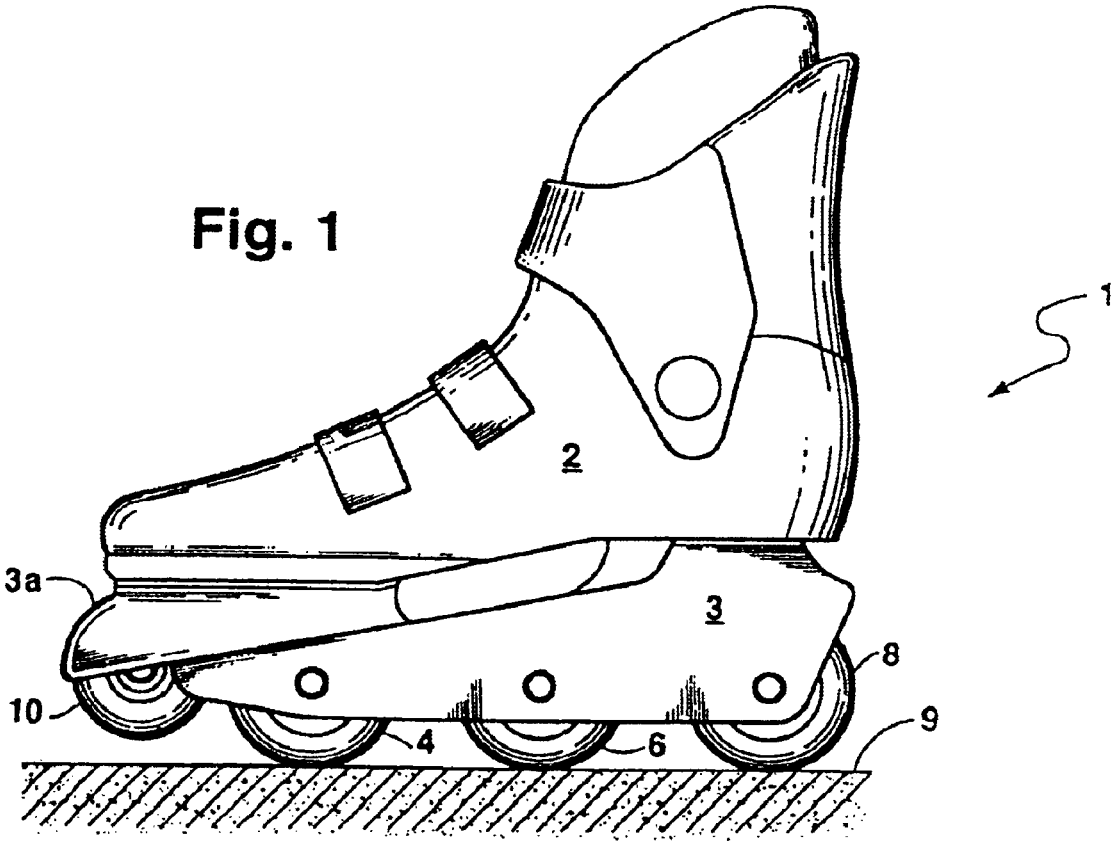
FIG. 1 is a side view of an in-line skate with an elevated front wheel in accordance with the invention.

With reference to FIG. 1, a skate such as an in-line skate 1 has a boot 2, a skate frame 3 and three regular wheels 4, 6 and 8 mounted to the frame as is well known in the art. All three of these wheels have the same radius and their centers lie along a common line, such that all three wheels will engage skating surface 9 at the same time. There is a fourth wheel referred to herein as a front wheel 10. Wheel 10 is elevated with respect to the other wheels such that when the other wheels engage the skating surface 9, wheel 10 is above the skating surface. To achieve this, wheel 10 may be smaller than the other wheels, or its axis may be above that of the other wheels, or a combination thereof.

Figure 2:
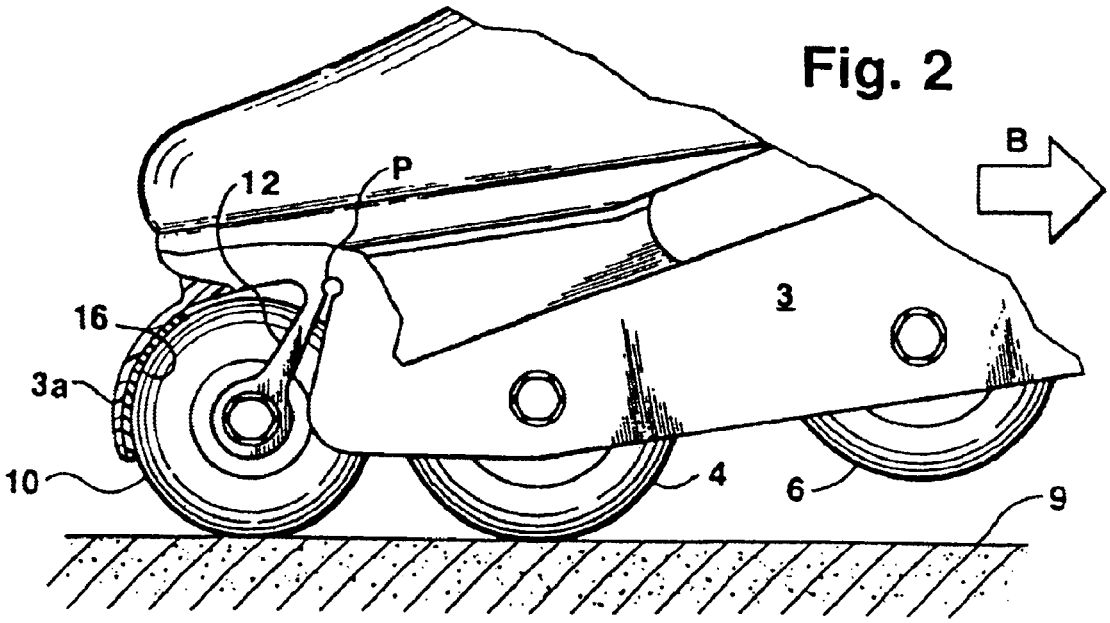
FIG. 2 is a broken away and enlarged side view of a portion of the skate of FIG. 1 showing the front wheel and a front wheel braking assembly, in accordance with the invention, with the brake engaged where the skater is skating rearward with pressure on the front wheel.

With reference to FIGS. 2, 3 and 5, front wheel 10 is mounted on two arms 12 integrally or unitarily formed with the frame 3. Frame 3 has a forward portion 3a inside which there is a brake pad 16. The arms 12 are formed so as to be biased forward against pad 16. The arms 12 support an axle 22 which passes through an aperture in the wheel. Axle 22 may be a bolt with a head 22*a* and a threaded end 22*b* having a nut 24 and a washer 26 thereon. Bearing structure may be in accordance with what is well known in the art.

With reference to FIGS. 1 through 4, operation of the safety brake will now be explained. When skating normally as in FIG. 1, in a forward or rearward direction, the front wheel 10 is elevated with respect to the skating surface 9. Therefore, the brake is disengaged even though the wheel 10 is biased against brake pad 16. In this embodiment, the arms 12 tend to bias the wheel to pivot clockwise around a pivot point P to bias the wheel forward. When a skater wants a push start, or wants to apply the brake to hold his/her ground, or as a brake when skating rearward, the skater rotates the skate so that the front wheel 10 engages the ground or skating surface 9. The second wheel 4 may also engage the ground. Skating rearward, or pushing rearward, provides a rearward thrust on front wheel 10. This rearward thrust causes a forward reaction force due to friction on the wheel, and the arms 12 pivot or tend to pivot clockwise, thus ensuring hard contact between the front wheel 10 and brake pad 16. The harder the skater pushes the harder the braking force becomes.

FIG. 2 shows a skater skating or pushing backwards in direction B and applying the brake.

If, as shown in FIG. 4, the skater is skating in a forward direction F, and is pushed forward onto wheel 10 or accidentally rotates his or her foot to cause wheel 10 to engage the skating surface 9, the frictional force between wheel 10 and surface 9 reduces the contact force between the wheel 10 and the brake pad 16. This ensures that the brake is not inadvertently engaged when skating in a forward direction so as to avoid tripping the skater.

FIG. 6 shows the brake pad and wheel engagement positions of FIGS. 2 and 4. Engagement is enhanced as in FIG. 2 for backward skating due to the friction force between the wheel and skating surface and wedge effect of the skater's weight on the angled arm 12. This is shown in phantom in FIG. 6.

Engagement is reduced in the solid portion of FIG. 6 which corresponds to FIG. 4, where the skater is skating forward, due to the effect of friction between the wheel and skating surface and thus minimizes or reduces the effect of a skater undesirably leaning forward when skating forward.

The position of FIG. 3 is the neutral position of the wheel and brake pad's engagement, where the wheel is elevated from the brake pad. This may be a free spinning position, but preferably there is still a slight braking force on the wheel. Thus, the neutral position may be between the positions of FIGS. 2 and 4, or less compressed than the position of FIG. 4, depending upon the user's weight and downward pressure in FIG. 4, and other factors including the characteristics of the arm 12, its angle, material, thickness and dimensions, and the skating surface.

With the construction in accordance with the invention, frictional force on the wheel from the brake increases if the wheel 10 touches the ground when the skater skates backward, and is decreased relative thereto if the wheel 10 touches the ground when the skater skates forward.

In other words, the forward sliding frictional force between the wheel 10 and skating surface increases the bias against the brake pad when skating backward, and the rearward sliding frictional force between the wheel 10 and skating surface reduces the bias against the brake pad when skating forward. Thus, the brake force when skating forward is self-reducing and when skating or pushing rearward it is self-energizing.

In normal operation, the bias on the wheel 10 against the brake pad would be such that it would not be overcome by the force of sliding friction between the wheel 10 and the skating surface when skating forward. A bump or other obstacle, however, could create sufficient backward force on the wheel 10 to separate it temporarily from the brake pad.

The brake pad may be made preferably of a tough, smooth, nonabrasive material with a high coefficient of sliding friction surface, such as urethane. This material has good wear-resistance yet also provides a secure braking force in conjunction with typical in-line skate wheel material of urethane. Other materials which would serve as a braking pad would be evident to those of ordinary skill in the art.

While the illustrated embodiment shows a front wheel mounting mechanism of two parallel arms biased forward or clockwise, and unitarily or integrally formed with the skating frame, these arms could be mounted on a pivot rod located at point P and biased forward. In addition, the biasing force may be changed by varying the arm's thickness, angle, pivot point location, or other parameters that may be apparent to those of ordinary skill in the art. It may be advantageous to reinforce the arms 12, particularly in the area of the pivot point P to avoid breakage.

The principles of braking suggest that one should choose a brake pad material and the other brake parameters such that the wheel to brake frictional force is easy for the skater to maintain a braking force that does not readily exceed the frictional force between the wheel and the skating surface to minimize the likelihood of skidding when applying the brake. In a preferred embodiment, the angle of the arm 12 may be 45°, greater than 45°, or less than 45° depending on the designed component or percentage of vertical thrust that is desired to be used to bias the wheel against the pad.

The invention provides activation and deactivation by the direction of thrust and the reaction force on the front wheel. Therefore, it provides a safe, foolproof braking system. In an alternate embodiment, the brake is formed by one or more bearings mounted to the skate frame. The principals governing operation of the invention are similar. In addition, if the user is skating forwards with the front wheel on the skating surface, the front wheel will be turning counterclockwise viewed from the left side. The bearing or bearings will be turning clockwise viewed from the same side. That is, it is preferred to keep light contact between the front wheel and the bearings. The bearings are preferably very low friction so as not to impede skating. They will spin freely in the counterclockwise direction when viewed from the left.

When the skater needs to push off or hold his or her ground in response to being pushed backwards, or to stop while skating backwards, if the skater has the front wheel on the skating plane, the front wheel will tend to turn clockwise when viewed from the left. However, the bearings, are preferably one way bearings which will not rotate counterclockwise when viewed from the left. Accordingly, the wheel will not rotate and the bearings will function as a brake.

In a further embodiment, the front wheel may be movably mounted so that its axis moves laterally forward when the skater is pushing off or skating backwards with the front wheel on the skating plane or surface. When the skater moves forward, the front wheel will move backwards away from the bearings.

With this construction, the skater can push off, and even walk forward or climb a hill using a pushing off type of motion. Such a motion, i.e., one which tend to rotate the front wheel clockwise when viewed from the left, will cause the brake to engage and give the skater traction. This would allow a skater, for example, to climb a quarter pipe with very little weight pressure on the front wheel. The bearing or bearings are preferably of military grade, i.e., high quality bearings and long lasting. Suitable bearings would be well known to those of ordinary skill in the art. Typical size bearings would be a length of one half inch and a diameter of one quarter inch.

The one way bearing or bearings have an axle which may be disposed in holes in the skate frame. Where multiple bearings are used, there are preferably on a curve equal distance from the wheel circumference.

Figure 7:
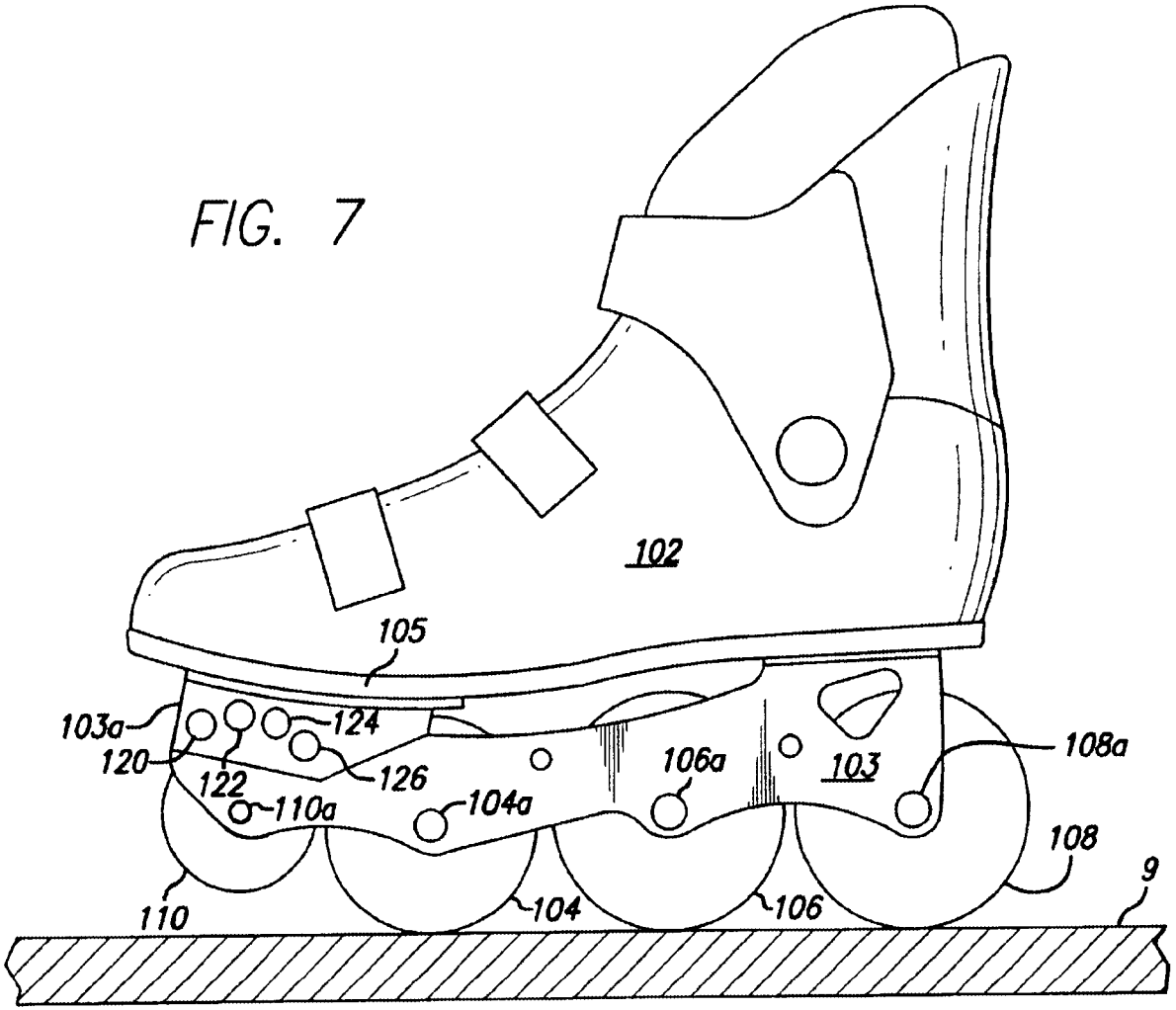
FIG. 7 is a left side view of a skate in accordance with a second embodiment of the invention using bearings as a brake.

One such bearing version of the invention is shown in FIG. 7. In this embodiment, a skate 102 has a sole 105 to which a skate frame 103 is attached. Skate frame 103 has a bearing support element 103*a* attached to it and/or the skate sole 105. Skate frame 103 has a series of holes 104*a*, 106*a*, 108*a* and 110*a* supporting axles for wheels 104, 106, 108 and 110. Wheels 106 and 108 are preferably standard in-line skate wheels. Wheel 104 is slightly smaller. The three wheels 104, 106 and 108 have the same skating plane and thereby engage skate surface 9 at the same time under normal skating.

Front wheel 110 is substantially smaller than wheel 104 and the other wheels. It does not normally engage the skating plane. In this embodiment, front wheel 110 is preferably directly under the ball of the foot. The rear most skating wheel 108 is preferably positioned to extend beyond the rear of a boot of skate 102.

Figure 8:
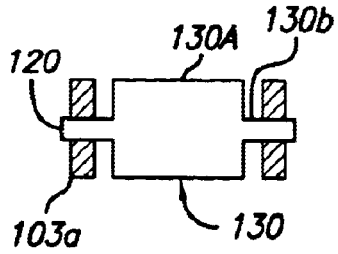
FIG. 8 is a partial sectional view of details of one bearing and a support element of the skate of FIG. 7.

In the embodiment of FIG. 7, there are four bearings. Accordingly there are four bearing support holes, 120, 122, 124 and 126 in the bearing support 103*a*. As shown in FIG. 8, each bearing 130 has a bearing surface 130*a* and an axle 130*b*, the ends of which are disposed in the support holes 120. Each bearing 130 is a one way bearing such that bearing element 130*a* rotates freely in one direction with respect to axle 130*b* but locks in the other direction.

The ends of axle 130*b* are fixed to the bearing support element 103*a*. The bearing surface is preferably smooth. The bearings are preferably of "military grade", and preferably one half inch long and one quarter inch in diameter.

Figure 9:
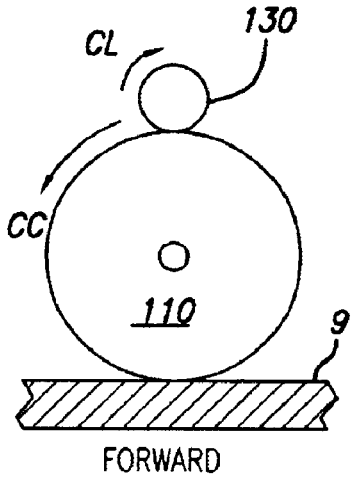
FIG. 9 is a schematic view of the front wheel and the bearing of the skate of FIGS. 7 and 8, for explaining operation of the bearings when skating forward with the front wheel on a skating surface.
Figure 10:
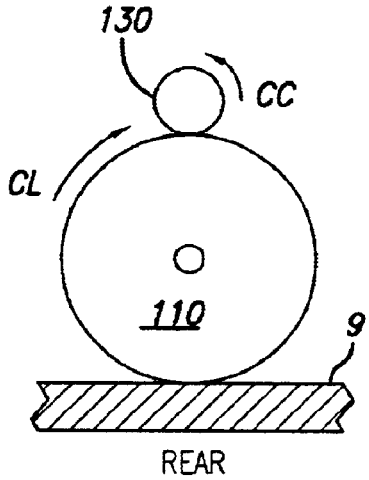
FIG. 10 is a view similar to that of FIG. 9 for explaining operation of the bearings when skating backwards with the front wheel on the skating surface.

With reference to FIGS. 9 and 10, the operation of the bearings will be explained. As in the prior embodiment, when the skater skates normally in a forward direction, if the skater leans forward such that the front wheel 110 touches the skating surface 9, the brake will not engage or at least not fully engage. As shown in FIG. 9, the front wheel 110 rotates counterclockwise when skating forward, such that each bearing 130 will rotate clockwise when viewed from the left. The bearings are set to freely rotate clockwise when viewed from the left.

When skating backwards, or pushing off, with the front wheel 110 engaging the skating surface 9, the front wheel 110 rotates or tends to rotate clockwise. The bearings 130 will tend to rotate counterclockwise. The bearings, as one way bearings, will not rotate in that direction. Accordingly, the friction between the bearings and the front wheel will act as a brake. The skater can push off, use it as a brake, or even use it to climb a quarter pipe or the like.

The bearing 130 and front wheel 110 should normally have at least a slight engagement so that the front wheel will only rotate in the counterclockwise direction.

Front wheel 110 should be of a very high quality, preferably of a type for skating for "extreme" conditions. The number of bearings may be varied. For example, three bearings may be used, e.g., by eliminating the bearing corresponding to support hole 126, two bearings may be used, e.g., by eliminating bearings corresponding to support holes 124 and 126, or one bearing may be used.

Figure 11:
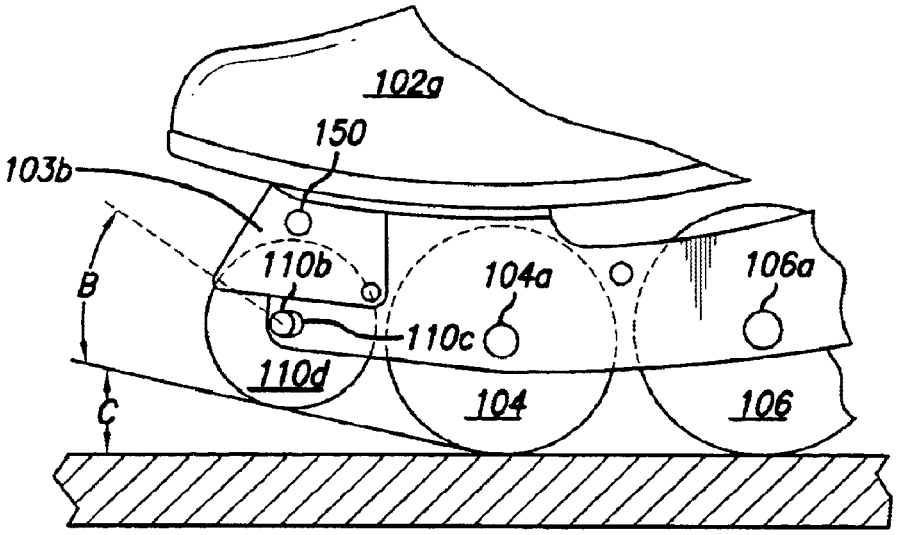
FIG. 11 is a partial view similar to that of FIG. 7 showing a third embodiment of the invention.
Figure 12:
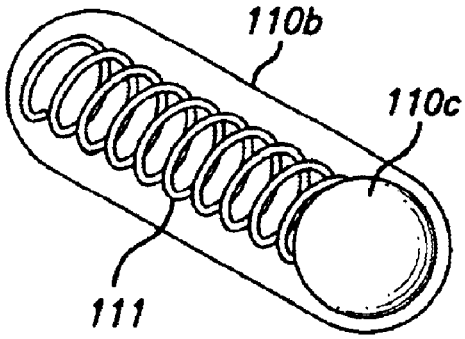
FIG. 12 is a partial schematic view of a spring mount for an axis of a bearing in the skate of FIG. 11 for explaining operation of the brake when skating forward.
Figure 13:
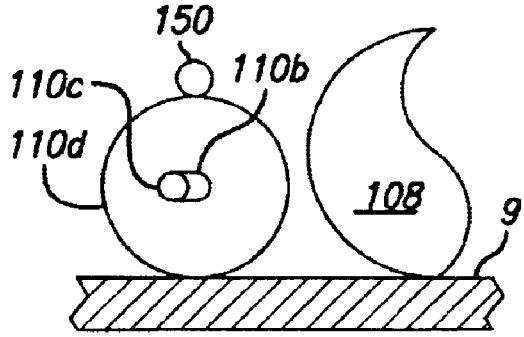
FIG. 13 is a partial view of a front wheel and adjacent wheel for explaining operation of the brake when skating backwards or pushing off with the front wheel contacting the skating surface.
Figure 14:
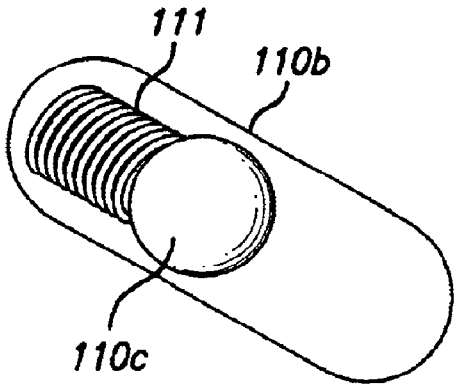
FIG. 14 is a view similar to FIG. 12 but showing the spring mount and bearing axis when skating rearward with the front wheel on the skating surface.

Another embodiment is shown in FIG. 11. In this embodiment, the front wheel 110*a* and bearing 150 do not normally engage or have very light engagement. Preferably, they do not engage. The front wheel 110*a* has its axle 110*c* mounted in a slot 110*b* formed in skate frame 103*c* of skate 102*a*. In frame support element 130*b* there is a hole for supporting bearing 150. Front wheel 110*d* is normally in the position shown in FIG. 11, where a tangent from wheel 104 where wheel 104 contacts skating plane 109, forms an angle C with the skating plane, preferably 20°, and then angle D with the axis of slot 110*b* preferably of 30°. Axle 110*c* may be spring biased via spring 111 in the position shown in FIG. 11 and FIG. 12. When the skater leans forward putting pressure on the wheel 110*d*, also causing frictional force with the skating surface on wheel 110*d*, the axle 110*c* presses forward against the spring 111 and enters the position in FIGS. 13 and 14 at or towards the upper/left portion of slot 110*b*. This causes the front wheel 110*d* to engage bearing 150 which is also a one way bearing operating the same as bearings 130 of FIGS. 7–10. In any embodiment, the front wheel may be made movable or can normally be in engagement with the bearing or bearings, and may be made with one, two, three, four or more bearings.

While the present invention has been described with regard to particular embodiments, it is recognized that additional variations of the present invention may be devised without departing from the inventive concept such as varying the number of wheels or the number of bearings.

What is claimed is:

1. A roller skate with a braking device, the skate having a boot with a toe section at a front end of the skate and a heel section at a rear end of the skate and a frame attached thereto, the frame supporting a plurality of wheels of the skate, the wheels defining a single skating plane, the braking device comprising:

a front wheel located proximate the toe section of the skate;

a brake member disposed proximate the front wheel and attached to the frame;

means for mounting the front wheel to the frame for normally positioning the front wheel against the brake member, wherein the brake member comprises at least one one-way bearing, the bearing being freely rotatable in a clockwise direction when viewed from the left, and being nonrotatable in a counterclockwise direction when viewed from the left, and wherein the front wheel is elevated with respect to the skating plane, and thereby is elevated with respect to a skating surface corresponding to the skating plane, and whereby the brake will be activated when skating or pushing rearward and moving the skater's foot to cause the front wheel to engage the skating surface, causing the front wheel to tend to rotate clockwise when viewed from the left, thereby causing the at least one bearing to tend to rotate counterclockwise, when viewed from the left, thereby locking against rotation, whereby friction between the at least one bearing and the front wheel acts as a brake and provides a braking force on the front wheel, and when skating forward and moving the skater's foot to cause the front wheel to engage the skating surface, the front wheel will be rotating counterclockwise causing the at least one bearing to rotate clockwise freely when viewed from the left, so that the front wheel will rotate.

2. The roller skate of claim 1 wherein there are at least three one-way bearings.

3. The roller skate of claim 1 wherein there are four one-way bearings.

4. A roller skate comprising:

a boot with a toe section at a front thereof and a heel section at a rear thereof;

a frame attached to the boot;

a plurality of wheels rotatably mounted to the frame and forming a single skating plane;

a front wheel located proximate the toe section of the skate;

a brake member disposed proximate the front wheel and mounted on the skate frame;

means for mounting the front wheel to the frame for normally biasing the front wheel rearward and downward away from the brake member to reduce the force of the wheel on the brake member tending to disengage the brake, the means for mounting being responsive to at least one of a rearward thrust and downward force on the skate to force the front wheel against the brake member;

wherein the brake member comprises at least one one-way bearing, the bearing being freely rotatable in a clockwise direction when viewed from the left, and being nonrotatable in a counterclockwise direction when viewed from the left, and wherein the front wheel is elevated with respect to the skating plane, and thereby is elevated with respect to a skating surface corresponding to the skating plane, and whereby the brake will be activated when skating or pushing rearward and moving the skater's foot to cause the front wheel to engage the skating surface, causing the front wheel to tend to rotate clockwise when viewed from the left, thereby causing the at least one bearing to tend to rotate counterclockwise, when viewed from the left, thereby locking against rotation, whereby friction between the at least one bearing and the front wheel acts as a brake and provides a braking force on the front wheel, and when skating forward and moving the skater's foot to cause the front wheel to engage the skating surface, the front wheel will be rotating counterclockwise freely in spite of any contact with the at least one one-way bearing, which would rotate clockwise freely when viewed from the left.

5. The roller skate of claim 4, wherein the means for biasing is responsive to the skater placing downward pressure on the front wheel to operate against the means for biasing such that the front wheel may be urged upward and forward due to downward pressure, but is also responsive to friction between the front wheel and skating surface tending to move the front wheel downward and rearward out of engagement with the at least one bearing, whereby the at least one bearing will rotate clockwise freely when viewed from the left, so that the front wheel will rotate, even if the front wheel is in contact with the at least one one-way bearing.

6. The roller skate of claim 4 wherein the brake member comprises at least three one-way bearings.

7. The roller skate of claim 4 wherein the brake member comprises four one-way bearings.

8. The roller skate of claim 4 wherein the wheels and the front wheel are disposed in the same plane.

* * * * *